US006848632B2

(12) United States Patent
Clark

(10) Patent No.: US 6,848,632 B2
(45) Date of Patent: Feb. 1, 2005

(54) POP-UP IRRIGATION SPRINKLER HAVING BI-LEVEL DEBRIS STRAINER WITH INTEGRAL RISER RATCHET MECHANISM AND DEBRIS SCRUBBER

(75) Inventor: Michael L. Clark, San Marcos, CA (US)

(73) Assignee: Hunter Industries, Inc., A Delaware Corporation, San Marcos, CA (US)

( * ) Notice: Subject to any disclaimer, the term of this patent is extended or adjusted under 35 U.S.C. 154(b) by 56 days.

(21) Appl. No.: 10/000,291

(22) Filed: Nov. 2, 2001

(65) Prior Publication Data

US 2002/0179734 A1 Dec. 5, 2002

Related U.S. Application Data

(63) Continuation-in-part of application No. 09/873,167, filed on Jun. 1, 2001.

(51) Int. Cl.[7] ..... B05B 15/10; B05B 3/00; B05B 3/04; B05B 15/02; F23D 11/38

(52) U.S. Cl. ..... 239/203; 239/204; 239/206; 239/240; 239/123; 210/449

(58) Field of Search ..... 239/203, 204, 239/206, 240, 123, 201, 205, 237, 242, 263, 103, 104, 106, 114, 115, 116; 137/242; 285/282, 300, 913; 210/449

(56) References Cited

U.S. PATENT DOCUMENTS

| | | | | | |
|---|---|---|---|---|---|
| 90,015 | A | * | 5/1869 | North et al. | 210/315 |
| 1,212,404 | A | * | 1/1917 | Robinson | 210/399 |
| 1,898,382 | A | * | 2/1933 | Mullaney | 210/302 |
| 2,665,009 | A | * | 1/1954 | Harstick | 210/449 |
| 3,695,450 | A | * | 10/1972 | Lieberman | 210/449 |
| 4,081,171 | A | | 3/1978 | Morgan et al. | 251/30 |
| 4,220,283 | A | | 9/1980 | Citron | 239/205 |
| 4,272,024 | A | * | 6/1981 | Kah, Jr. | 239/206 |
| 4,360,037 | A | | 11/1982 | Kendall | 137/242 |
| 4,892,252 | A | | 1/1990 | Bruninga | 239/205 |
| 5,213,303 | A | | 5/1993 | Walker | 251/30.02 |
| 5,996,608 | A | | 12/1999 | Hunter et al. | 137/244 |
| 6,186,413 | B1 | * | 2/2001 | Lawson | 239/205 |

FOREIGN PATENT DOCUMENTS

| | | |
|---|---|---|
| NZ | 196877 | 4/1923 |

* cited by examiner

*Primary Examiner*—Michael Mar
*Assistant Examiner*—Darren Gorman
(74) *Attorney, Agent, or Firm*—Michael H. Jester

(57) ABSTRACT

A frusto-conical strainer is mounted on the lower end of a pop-up riser for filtering out debris from water entering the lower inlet end of a surrounding outer housing to prevent clogging of the nozzle orifice or damage to mechanical components within a sprinkler. A cylindrical scrubber including a circumferential array of resilient arms is anchored at the lower inlet end of the outer housing. Wiper blades on the upper ends of the arms press against the outer surface of the strainer to scrape debris and algae therefrom as the riser extends and retracts. The strainer may have finer and coarser mesh sections for different levels of filtering in a sprinkler having multiple internal water flow paths. A plurality of circumferentially spaced projections on the strainer deflect past a plurality of circumferentially spaced ribs formed on the interior wall of the outer housing to provide a riser ratchet mechanism.

8 Claims, 12 Drawing Sheets

POP-UP IRRIGATION SPRINKLER HAVING BI-LEVEL DEBRIS STRAINER WITH INTEGRAL RISER RATCHET MECHANISM AND DEBRIS SCRUBBER

CROSS-REFERENCE TO RELATED APPLICATION

This application is a continuation-in-part of pending U.S. patent application Ser. No. 09/873,167 of Michael L. Clark, filed Jun. 1, 2001 and entitled "Rotor Type Sprinkler with Insertable Drive Subassembly Including Horizontal Turbine and Reversing Mechanism."

FIELD OF THE INVENTION

The present invention relates to irrigation equipment, and more particularly, to sprinklers of the type that have a pop-up riser with a nozzle that distributes water over turf or other landscaping.

BACKGROUND OF THE INVENTION

Many regions of the world have inadequate rainfall to support lawns, gardens and other landscaping during dry periods. Sprinklers are commonly used to distribute water over such landscaping in commercial and residential environments. The water is supplied under pressure from municipal sources, wells and storage reservoirs.

Generally sprinklers fall into several basic categories, including hose end, drip, spray, impact, rotary stream and rotor types. For convenience, reliability and economy, most vegetation around residences, commercial sites, golf courses and playing fields utilize spray, impact and/or rotor type sprinklers which are usually connected to series of underground pipes. Valves are connected to the pipes and are typically opened and closed by a programmable electronic irrigation controller.

Spray type sprinklers are usually only used for watering smaller areas. Rotor type sprinklers pioneered by Edwin J. Hunter of Hunter Industries, Inc. have largely supplanted impact drive sprinklers for watering larger areas, particularly golf courses and playing fields. Rotor type sprinklers are quieter, more reliable and distribute a relatively precise amount of precipitation more uniformly over a more accurately maintained sector size.

Both spray type and rotor type sprinklers employ an extensible riser which pops up out of a fixed outer housing when water pressure is applied. The riser has a nozzle from which water is distributed. In rotor type sprinklers the nozzle is located in a rotating head or turret mounted at the upper end of the riser. The tiny orifices in spray type sprinkler nozzles are highly susceptible to clogging by dirt and other debris. The riser of a rotor type sprinkler incorporates a turbine which drives the rotating head via a gear train reduction, reversing mechanism and arc adjustment mechanism. Rotor type sprinklers used on golf courses sometimes include an ON/OFF diaphragm valve in the base thereof which is pneumatically or electrically controlled. The diaphragm valves and turbines of rotor type sprinklers are highly susceptible to damage by dirt and other debris.

Irrigation riser assemblies, either gear driven or spray, require some means of fixing the rotational position of the riser relative to the outer sprinkler housing within which the riser telescopes. If the spray pattern is a part circle or the spray pattern is oriented to the landscape in some manner the riser also needs some means for permitting the relative rotational position of the riser relative to the outer housing.

The conventional way of accomplishing this result requires a complex and expensive cooperating rib structure as disclosed in U.S. Pat. No. 4,220,283. Typically a second part is required to interface with the ribs formed on the inner wall of the outer housing. Those sprinkler designs that do not use a second part use a solid ring with teeth that is part of the riser and which interfaces with the ribs formed on the inner wall of the outer housing. These molded teeth have a short life because they are solid and relatively inflexible and therefore tend to break and/or abrade over time, dependent upon the amount of manual rotation of the riser relative to the outer housing.

It has heretofore been common to include mesh screens or strainers at the lower inlet ends of both spray type and rotor type sprinklers to avoid clogging and damage to critical components otherwise afflicted by dirt and other debris carried in the water supply. However, any strainer in an irrigation sprinkler can itself become clogged or covered with debris in the form or organic and/or inorganic matter. The flow of water can become so impaired in a spray type sprinkler that the riser will not extend. In a rotor type sprinkler the flow of water can become so impaired that the turbine will not properly drive the nozzle through its rotational arc. The required degree of filtering of the incoming water is not always the same for the nozzle as the mechanical drive components of a rotor type sprinkler. A rotor type of sprinkler has a relatively large nozzle but its stator jets, for example, may be very susceptible to particle clogging. A fine mesh debris strainer may not be needed in a particular flow path within a rotor type sprinkler and may impose excessive flow resistance that can limit the reach of the rotor's water stream.

SUMMARY OF THE INVENTION

It is therefore a primary object of the present invention to provide a pop-up sprinkler with the capability for screening incoming water of debris of more than one particle size.

It is another object of the present invention to provide a sprinkler having a self-cleaning debris strainer.

It is still another object of the present invention to provide a sprinkler having a simpler, less expensive riser ratchet mechanism.

According to one aspect of the present invention, an irrigation sprinkler includes an outer housing having a lower inlet end connectable to a source of pressurized water. A riser is vertically reciprocable along a vertical axis within the outer housing between extended and retracted positions when the source of pressurized water is turned ON and OFF. A nozzle is mounted at an upper end of the riser for distributing water therefrom. A strainer is mounted inside the outer housing and is configured to filter debris from water passing through the lower inlet end of the outer housing. A scrubber is mounted within the outer housing and is configured for scraping accumulated debris from the strainer.

DESCRIPTION OF THE PREFERRED EMBODIMENTS

The entire disclosure of the aforementioned U.S. patent application Ser. No. 09/873,167 of Michael L. Clark is specifically incorporated herein by reference.

Figure 1:
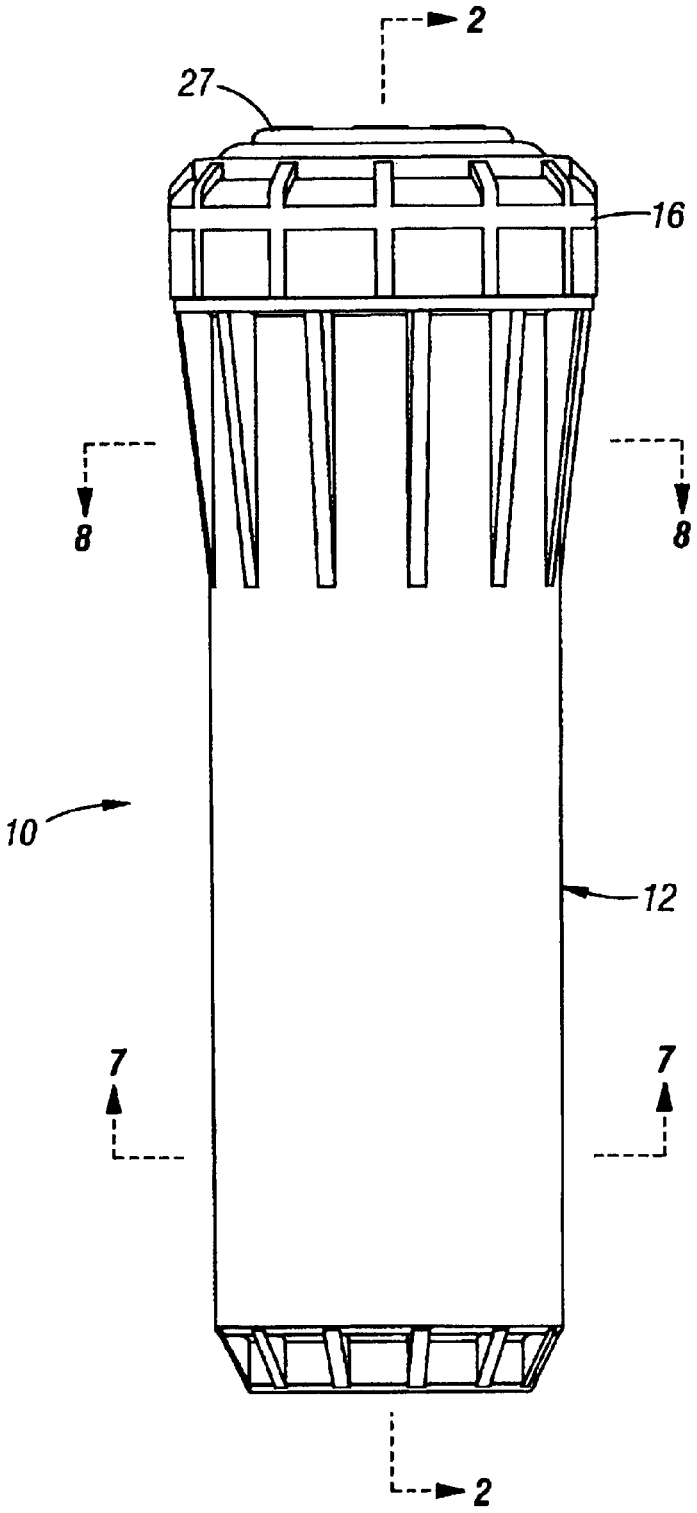
FIG. 1 is a side elevation view of a rotor type sprinkler in accordance with the preferred embodiment of the present invention.
Figure 2:
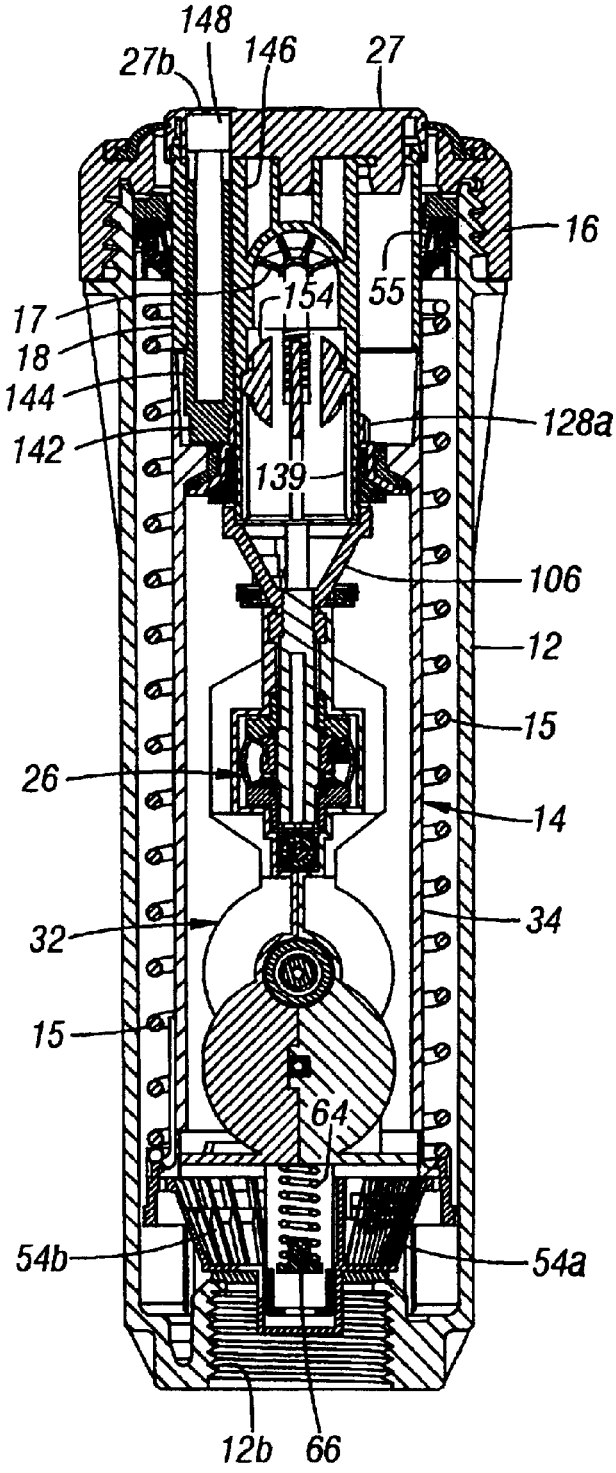
FIG. 2 is a vertical sectional view of the sprinkler taken along line 2—2 of FIG. 1.
Figure 4:
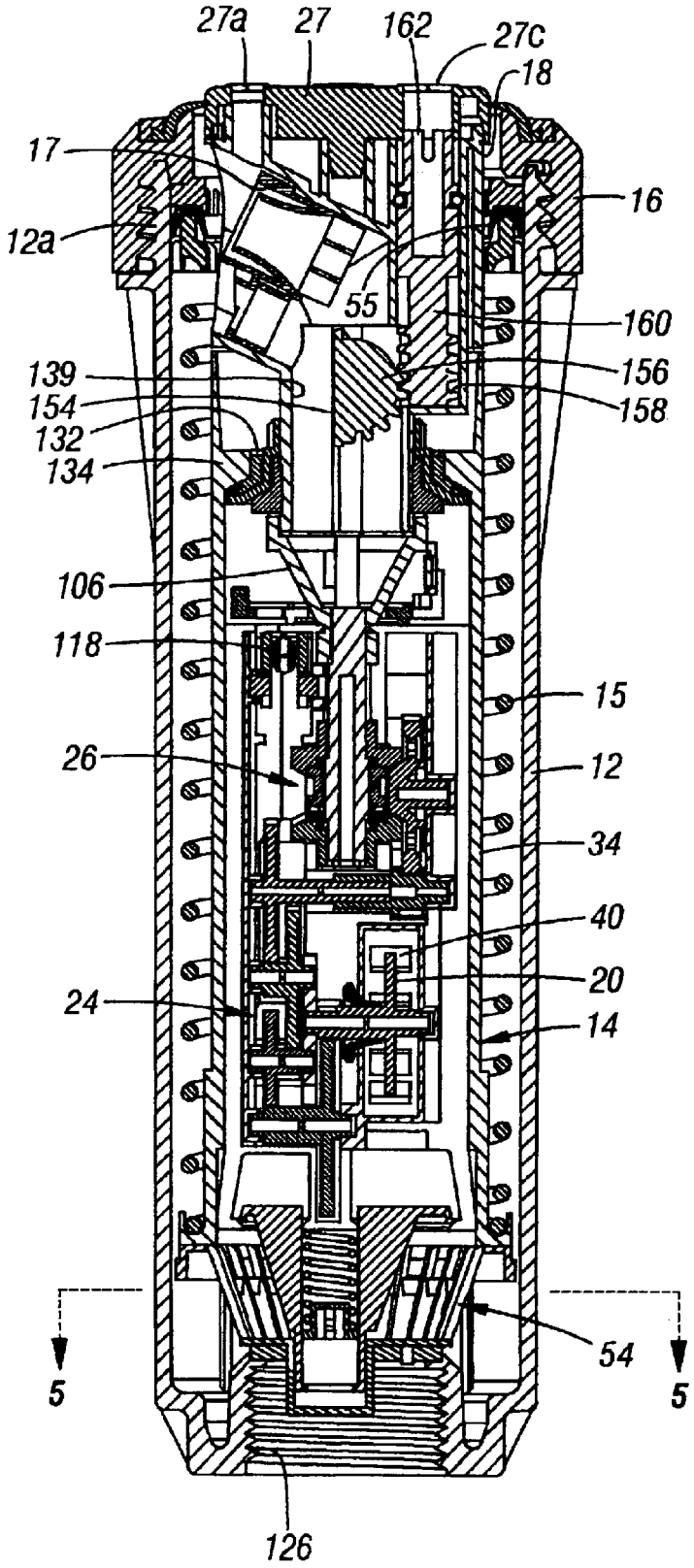
FIG. 4 is a vertical sectional view of the sprinkler taken along line 4—4 of FIG. 3.
Figure 6:
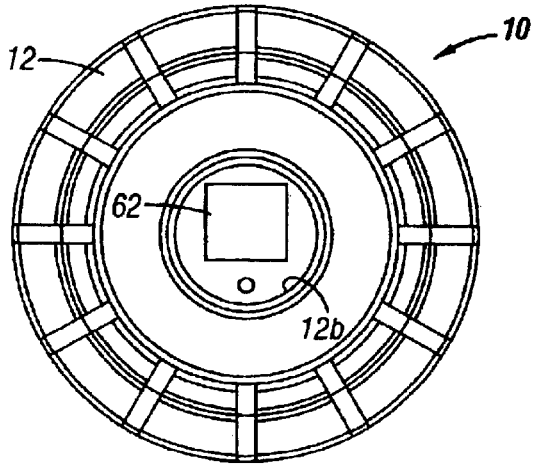
FIG. 6 is a bottom plan view of the sprinkler taken from the lower end of FIG. 1.

In accordance with the present invention, a pop-up rotor type sprinkler 10 (FIG. 1) includes an outer cylindrical housing 12 having a lower end connectable to a source of pressurized water (not illustrated) and an inner cylindrical riser 14 (FIGS. 2 and 4) that is vertically reciprocable along a vertical axis within the outer housing 12 between extended and retracted positions when the source of pressurized water is turned ON and OFF. The retracted or lowered position of the riser 14 is illustrated in FIGS. 2 and 4. The sprinkler 10 is normally buried in the ground with its upper end level with the surface of the soil. The riser 14 pops up to spray water on the surrounding landscaping in response to commands from an electronic irrigation controller that turn a solenoid actuated water supply valve ON in accordance with a water program previously entered by a homeowner or by maintenance personnel. When the irrigation controller turns the solenoid OFF, the flow of pressurized water to the sprinkler 10 is terminated and the riser retracts so that it will not be unsightly and will not be an obstacle to persons walking or playing at the location of the sprinkler 10, or to a mower.

Figure 3:
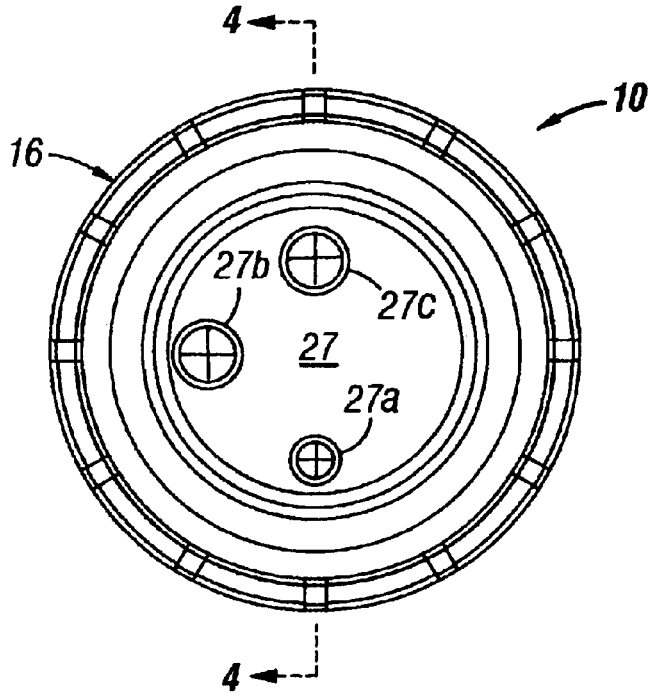
FIG. 3 is a top plan view of the sprinkler taken from the upper end of FIG. 1.
Figure 5:
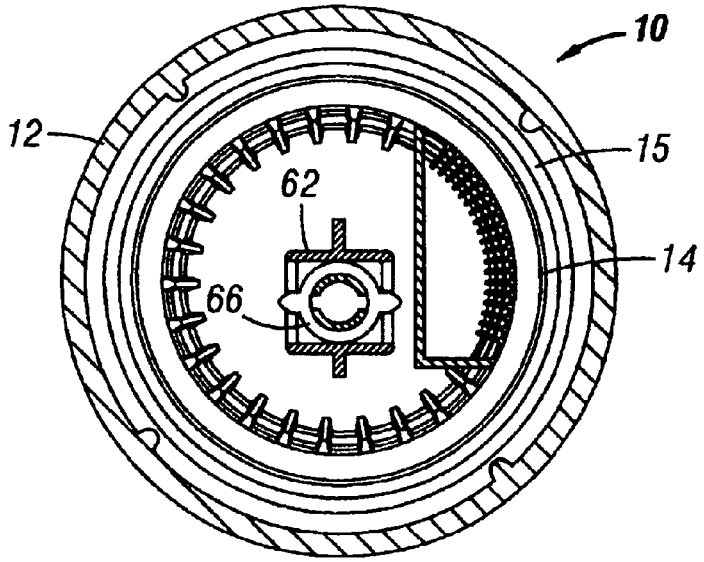
FIG. 5 is a horizontal sectional view of the sprinkler taken along line 5—5 of FIG. 4.

The riser 14 (FIGS. 2 and 3) is biased to its retracted position by a large coil spring 15 that surrounds the riser 14. The lower end of the coil spring 15 is retained by a flange 14*a* (FIG. 4) formed on the lower end of the riser 14. The upper end of the coil spring 15 is retained by a female threaded cap 16 that screws over a male threaded exterior segment 12*a* (FIG. 4) at the upper end of the outer housing 12. A pair of containment rings are positioned below the cap 16 that are separated by a flexible seal 55 (FIGS. 2 and 4). A nozzle 17 is mounted in a rotatable head or turret 18 at an upper end of the riser 14 for rotation about a vertical axis.

A turbine 20 (FIG. 4) is mounted inside the riser 14 for rotation about a horizontal axis, as distinguished from the vertical axis. A drive mechanism connects the turbine 20 to the turret 18 containing the nozzle 17 so that when the source of pressurized water is turned ON the resulting rotation of the turbine 20 by the pressurized water will rotate the nozzle 17 about the vertical axis. The turbine 20 drives a gear train reduction 24 that in turn drives a reversing mechanism 26. Except for the various springs and axles and the elastomeric components specifically identified, the components of the sprinkler 10 are made of injection molded thermoplastic material.

The outer housing 12, the inner housing 14, and the cap 16 are preferably molded of UV resistant black colored ABS plastic. A cap member 27 (FIGS. 2–4) covers the upper end of the turret 18. The cap member 27 is molded of a UV resistant black colored elastomeric material and has three cross-hair slits 27*a*, 27*b* and 27*c* (FIG. 3) through which the shaft of a conventional HUNTER® hand tool may be inserted to raise and lower a flow stream interrupter, adjust one of the arc limits or actuate a flow stop valve.

Figure 9:
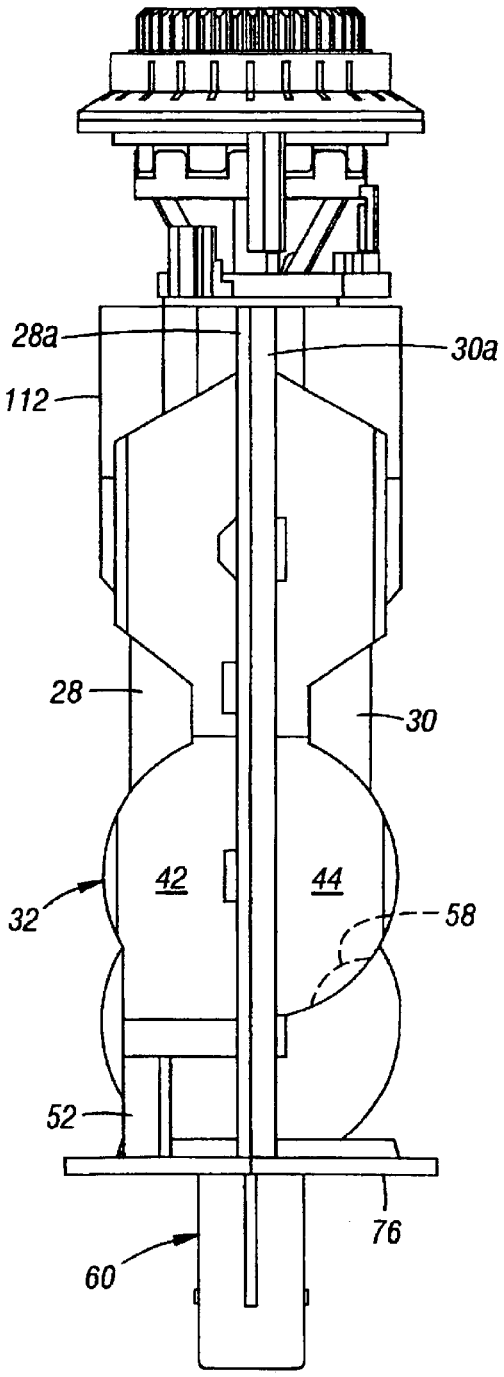
FIG. 9 is a side elevation view of the drive subassembly of the sprinkler of FIG. 1.

The turbine 20, gear train reduction 24 and reversing mechanism 26 are assembled inside one of two case members 28 and 30 to form a self-contained drive subassembly 32 (FIGS. 2, 4 and 9). The case members 28 and 30 extend vertically and form opposite halves of a hollow container. The case members 28 and 30 are joined together along planar abutting peripheral flanges such as 28*a* and 30*a* visible in FIG. 9 before being inserted into the cylindrical inner housing 34 that forms the exterior of the riser 14. The case members 28 and 30 may be joined by sonic welding, adhesive, or other suitable means once the drive mechanisms mounted therein have been tested and found to be fully operative.

Figure 7:
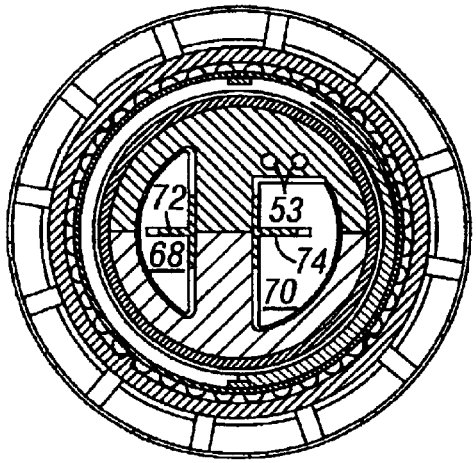
FIG. 7 is a horizontal sectional view of the sprinkler taken along line 7—7 of FIG. 1.
Figure 8:
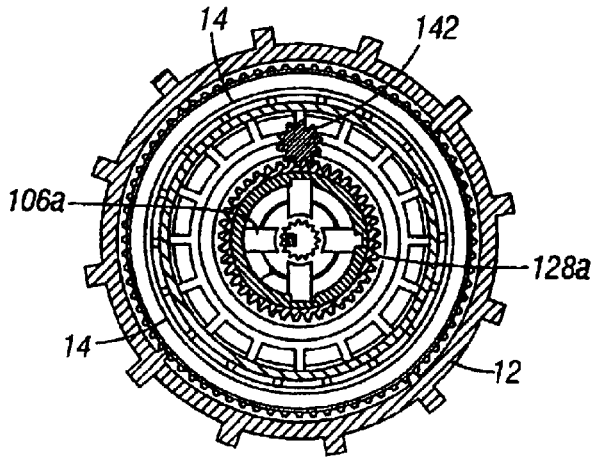
FIG. 8 is a horizontal sectional view of the sprinkler taken along line 8—8 of FIG. 1.

A vertically elongated rectangular hollow chute 52 (FIG. 9) provides a water flow path to a pair of inlet holes 53 (FIG. 7) to the housing portion 42 for directing a stream of water against the hollow rearward facing sides of the buckets 40 of the Pelton turbine 20. The chute 52 extends tangentially to the outer circumference of the turbine 20 for maximum efficiency in directing the stream of water that flows through same to impart rotation to the turbine 20. Pressurized water enters the cylindrical outer housing 12 through its female threaded lower inlet 12*b* (FIG. 4) and passes through a frusto-conical screen or strainer 54. A first portion of this water then passes a finer mesh section 54*a* of the strainer 54 and then through the chute 52 (FIG. 9) and the inlet holes 53 (FIG. 7) and drives the turbine 20.

Figure 10:
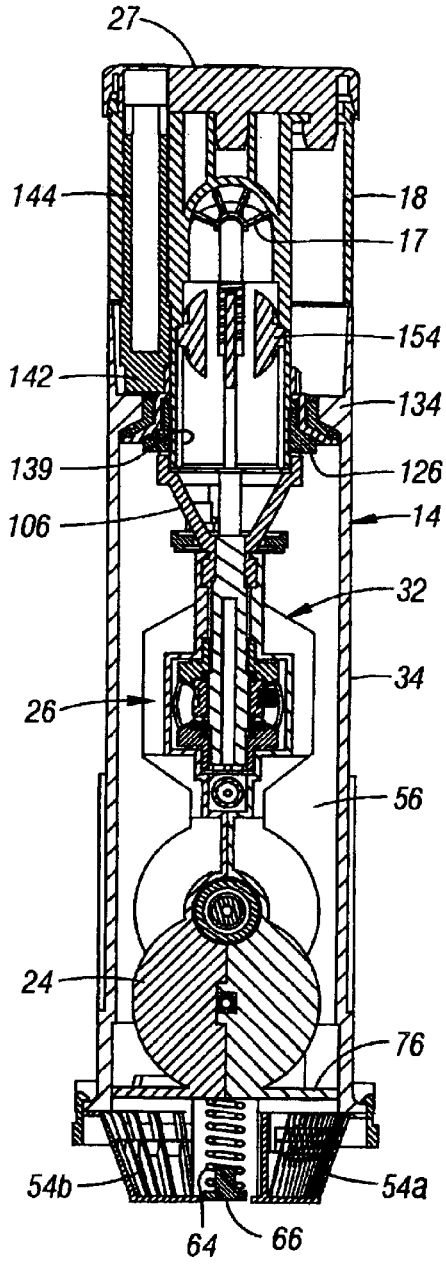
FIG. 10 is a vertical sectional view of the riser of the sprinkler of FIG. 1.

A second portion of the water flows through a coarser mesh section 54*b* of the strainer 54 and then vertically through the space 56 (FIG. 10) between the exterior of the drive subassembly 32 and the cylindrical inner housing 34 of the riser 14 and out the nozzle 17. The finer and coarser mesh sections 54*a* and 54*b* of the strainer 54 are circumferentially spaced from each other. The sections 54*a* and 54*b* are made of an injection molded lattice of rectangular openings of pre-selected size designed to capture and prevent the passage of debris particles larger than a predetermined minimum dimension. The square holes in the coarser mesh section 54*b* are larger than the square holes in the finer mesh section 54*a*.

The first portion of water that drives the turbine 20 passes out of the drive subassembly 32 through a round outlet aperture 58 (FIG. 9) in a lower part of the periphery of the annular housing portion 44. The outlet aperture 58 is illustrated in phantom lines in FIG. 9. The first portion of the water exiting the outlet aperture 58 joins the upwardly flowing second portion flowing through the space 56 (FIG. 10) and ultimately exits the riser 14 via the nozzle 17 along with the second portion of the water. Less than five percent of the water flowing through the sprinkler 10 actually drives the turbine 20. The remainder flows directly to the nozzle 17 via the space 56 between the drive subassembly 32 and the inner housing 34. Since the bulk of the water never reaches or comes into contact with the sensitive mechanisms inside the drive subassembly 32 it need only be coarsely filtered, and the reach of the stream of water ejected from the nozzle 17 is maximized.

The sprinkler 10 advantageously divides the water that flows into the riser 14 into two different portions and subjects them to different levels of filtering. A first portion that enters the drive subassembly 32 must pass through a finer mesh section 54*a* (FIG. 2) of the strainer 54 than the second portion. The second portion of the water only flows around the drive subassembly 32 and therefore only passes through a coarser mesh section 54*b* of the strainer 54. The mesh sections 54*a* and 54*b* represent separate filters for different portions of the water inflow. The water that comes into contact with the delicate turbine 20 is subject to more intensive filtering than the water that only flows around the drive assembly 32. However, it is still necessary to subject the water that bypasses the turbine 20 to some degree of filtering to protect, for example, the smallest orifice in the nozzle 17.

Figure 11:
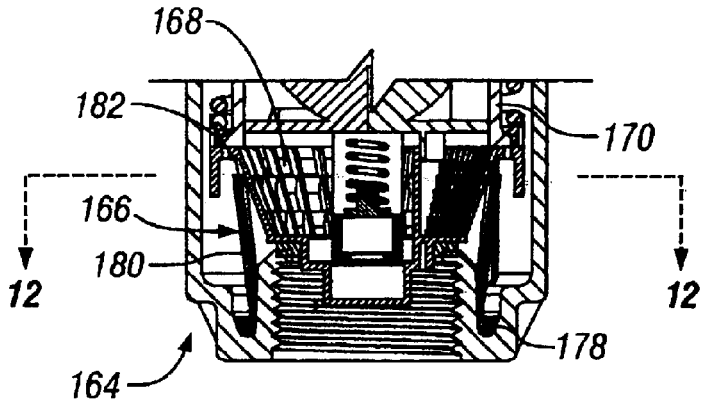
FIG. 11 is a fragmentary vertical sectional view of the lower end of an alternate embodiment of the sprinkler of the present invention taken along line 11—11 of FIG. 19 illustrating its bi-level strainer and scrubber.
Figure 12:
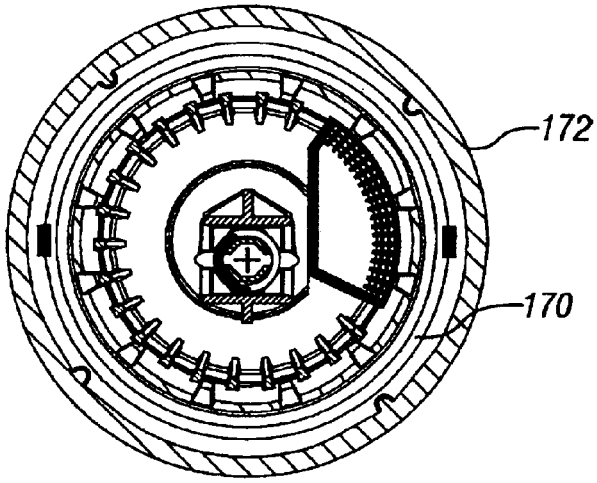
FIG. 12 is a horizontal cross-sectional view taken along line 12—12 of FIG. 11.
Figure 13:
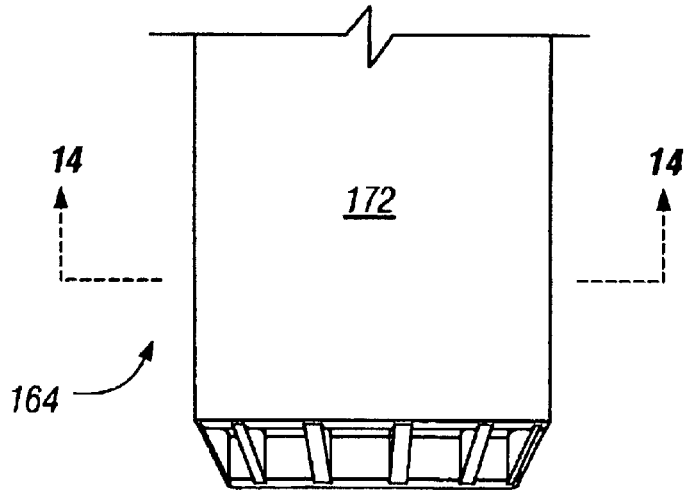
FIG. 13 is a side elevation view of the lower end of the alternate sprinkler embodiment illustrated in FIG. 11.
Figure 14:
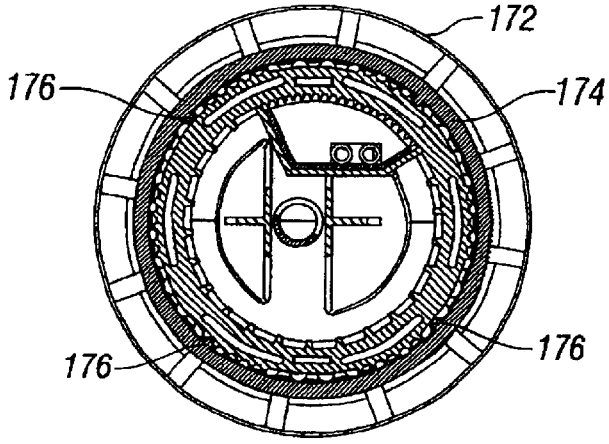
FIG. 14 is a horizontal cross-sectional view taken along line 14—14 of FIG. 13.
Figure 15:
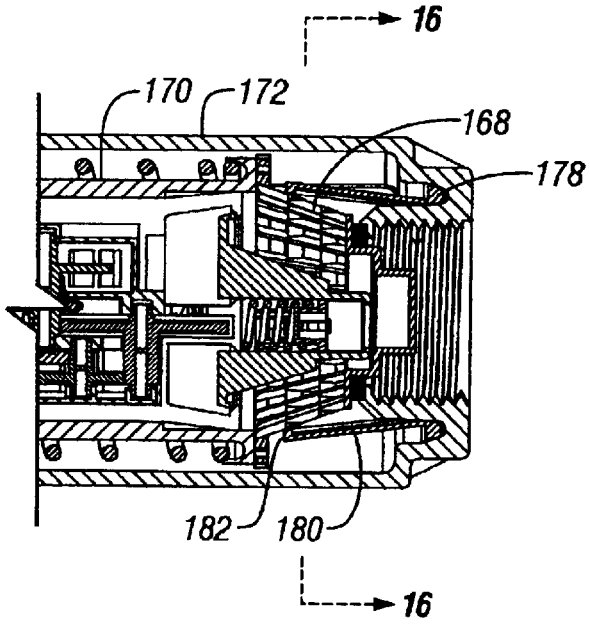
FIG. 15 is a vertical sectional view of the alternate embodiment of the sprinkler taken along line 15—15 of FIG. 18.
Figure 16:
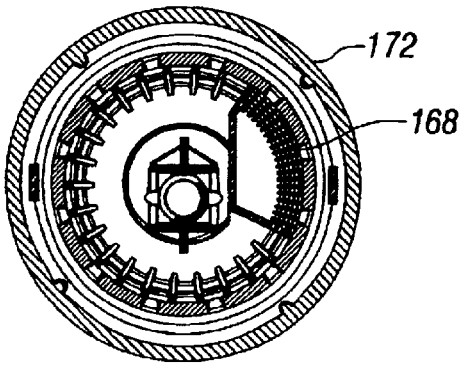
FIG. 16 is a horizontal cross sectional view of the lower end of the alternate embodiment taken along line 16—16 of FIG. 15.
Figure 17:
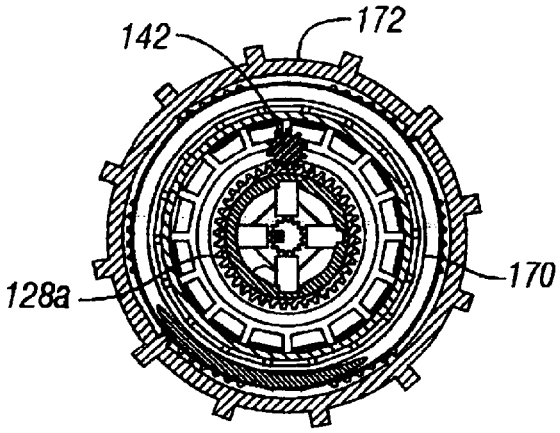
FIG. 17 is a horizontal cross sectional view of the alternate embodiment taken along line 17—17 of FIG. 19.
Figure 18:
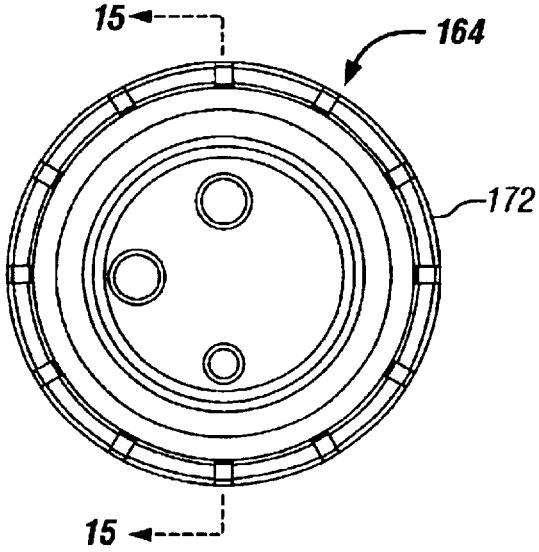
FIG. 18 is a top plan view of the alternate embodiment.
Figure 19:
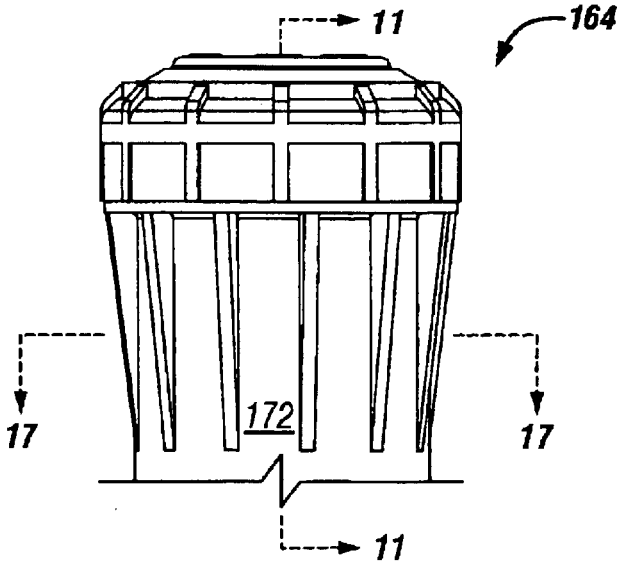
FIG. 19 is a side elevation view of the upper end of the alternate embodiment.
Figure 20:
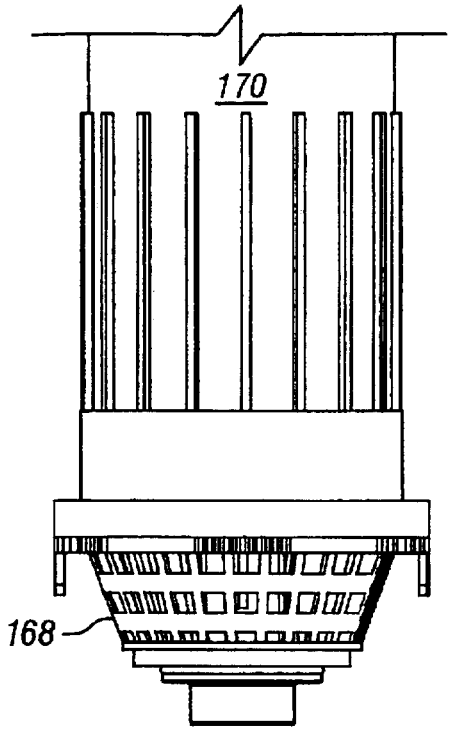
FIG. 20 is a fragmentary side elevation view of the lower end of the riser of the alternate embodiment of the sprinkler showing its ribbed inner cylindrical housing.
Figure 21:
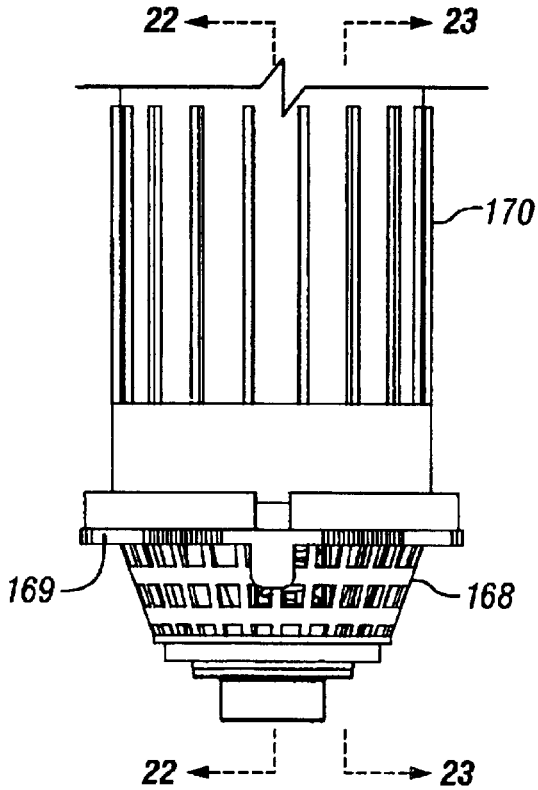
FIG. 21 is a fragmentary side elevation view of the lower end of the riser of the alternate embodiment of the sprinkler showing its ribbed inner cylindrical housing and rotated ninety degrees about a vertical axis from the view of FIG. 20.
Figure 22:
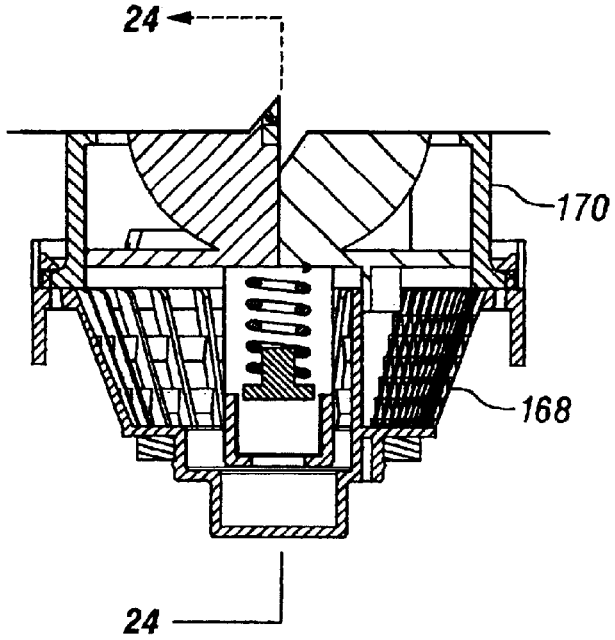
FIG. 22 is a vertical sectional view taken along line 22—22 of FIG. 21.
Figure 23:
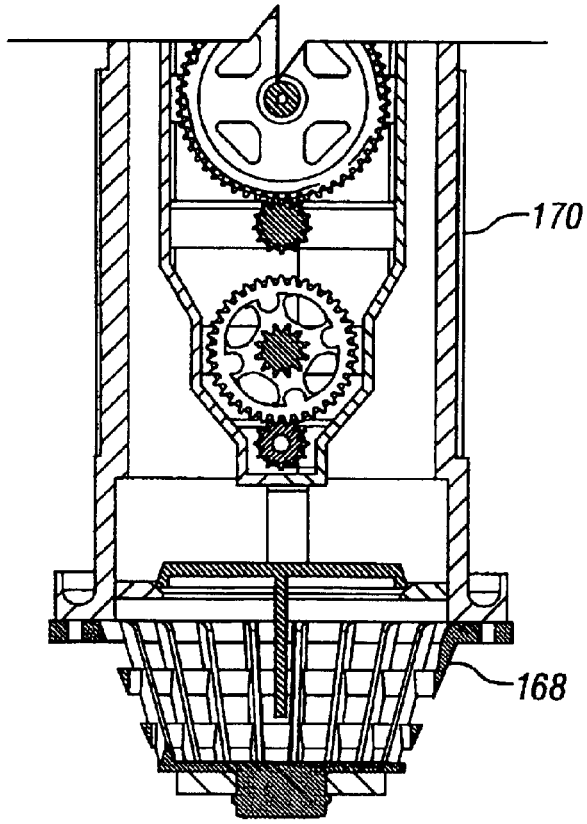
FIG. 23 is a vertical sectional view taken along line 23—23 of FIG. 21.
Figure 24:
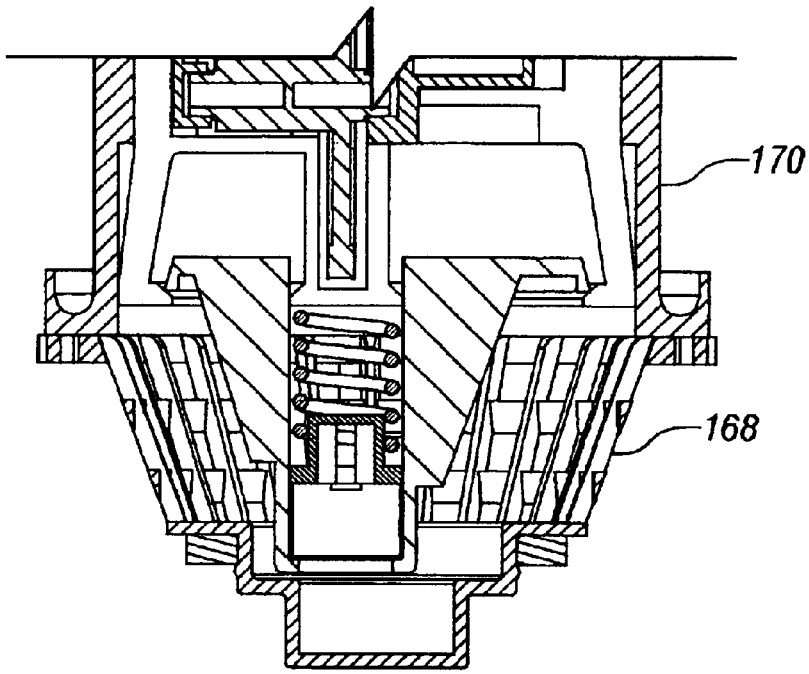
FIG. 24 is a vertical sectional view taken along line 24—24 of FIG. 22.
Figure 25:
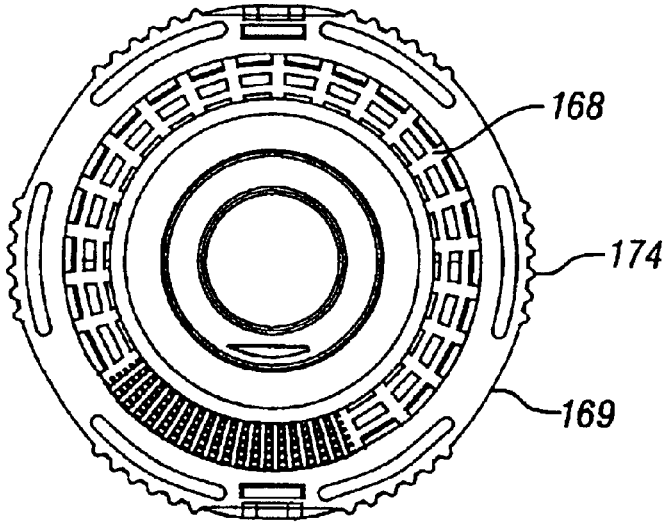
FIG. 25 is a bottom plan view of the riser of the alternate embodiment of the sprinkler taken from the lower end of FIG. 21.

FIGS. 11–25 illustrate an alternate embodiment 164 of our sprinkler which is similar to the sprinkler 10 of FIGS. 1–10 except that the sprinkler 164 has a scrubber 166 (FIG. 11) that scrapes and cleans dirt, algae and other debris off of a frusto-conical bi-level screen or strainer 168 each time the inner riser 170 vertically extends and retracts. In addition, the inner riser 170 of the sprinkler 164 incorporates a novel ratchet mechanism that normally fixes the rotational position of the inner riser 170 within the outer housing 172 but permits the inner riser 170 to be rotated relative to the outer housing 172 to orient the selected arc over the desired area of coverage. The bi-level strainer 168 is formed with integral ratchet projections in the form of a plurality of circumferentially spaced rounded projections or teeth 174 (FIGS. 14 and 25) on an upper ring portion 169 (FIG. 21) thereof. Due to the resilient flexible construction of the strainer 168 the teeth 174 can deflect radially inwardly past mating circumferentially spaced vertical ribs 176 (FIG. 14) molded on the interior wall of the outer housing 172. This permits the inner riser 170 to be rotated to a fixed position and maintain that position after arc adjustment.

The scrubber 166 (FIG. 11) has a vertically split generally cylindrical configuration that deflects or expands into a shape that is complementary to the frusto-conical configuration of the bi-level strainer 168. The lower end of the scrubber 166 has an annular ring 178 that snaps into a conformably shaped annular recess in the lower end of the outer housing 172. The scrubber 166 has multiple vertically extending slits defining resilient arms 180 (FIGS. 11 and 15) each provided at its upper end with a curved, inwardly directed wiper blade 182. The resilient arms 180 firmly press the blades 182 against the strainer 168 as the riser 170 extends and retracts. The arms 180 are circumferentially spaced and extend vertically so that each wiper blade 182 scrapes a corresponding outer surface area of the frusto-conical bi-level strainer 168.

While I have described preferred embodiments in the form of rotor type sprinklers having bi-level debris strainers with integral ratchet mechanisms and cooperating debris scrubbers, it will be apparent to those skilled in the art that my invention can be modified in both arrangement and detail. My riser ratchet and strainer scrubber improvements may also be incorporated into pop-up spray type sprinklers. Bi-level straining is generally not needed in a spray type sprinkler although it could be utilized if different flow paths terminated in nozzle orifices of different sizes. Means for scraping accumulated debris from the strainer could be provided in the form of a scrubber that is attached to the lower end of the riser that scrapes a stationary strainer mounted in the lower end of the outer sprinkler housing. Alternatively, means for scraping the strainer could be provided in the form of a free floating scrubber that agitates around a cylindrical strainer similar to the arrangement disclosed in U.S. Pat. No. 5,996,608 of Richard E. Hunter et al. granted Dec. 7, 1999, the entire disclosure of which is specifically incorporated herein by reference. Therefore the protection afforded my invention should only be limited in accordance with the scope of the following claims:

I claim:

1. An irrigation sprinkler, comprising:

an outer housing having a lower inlet end connectable to a source of pressurized water;

a riser vertically reciprocable along a vertical axis within the outer housing between extended and retracted positions when the source of pressurized water is turned ON and OFF;

a nozzle mounted at an upper end of the riser for distributing water therefrom; and a strainer mounted inside the outer housing and configured to filter debris from water passing through the lower inlet end of the outer housing, the strainer having a finer mesh section and a coarser mesh section joined with the finer mesh section circumferentially spaced from one another.

2. The irrigation sprinkler of claim 1 wherein the strainer is mounted to a lower end of the riser.

3. The irrigation sprinkler of claim 1 and further comprising a scrubber mounted within the outer housing and configured for scraping accumulated debris from the strainer.

4. An irrigation sprinkler, comprising:

an outer housing having a lower inlet end connectable to a source of pressurized water and a plurality of circumferentially spaced vertically extending ribs formed on an interior wall thereof;

a riser vertically reciprocable along a vertical axis within the outer housing between extended and retracted positions when the source of pressurized water is turned ON and OFF;

a nozzle mounted at an upper end of the riser for distributing water therefrom; and a strainer mounted inside the outer housing and configured to filter debris from water passing through the lower inlet end of the outer housing, the strainer having a plurality of circumferentially spaced projections configured and positioned to engage the ribs on the interior wall of the outer housing and deflect past the same to provide a ratchet mechanism that allows for adjustably positioning the riser in a predetermined fixed rotational relationship with the outer housing.

5. The irrigation sprinkler of claim 4 wherein the strainer is mounted to a lower end of the riser.

6. The irrigation sprinkler of claim 4 and further comprising a scrubber mounted within the outer housing and configured for scraping accumulated debris from the strainer.

7. The irrigation sprinkler of claim 4 wherein the strainer has a finer mesh section and a coarser mesh section.

8. The irrigation sprinkler of claim 4 wherein the projections are formed as rounded teeth.

* * * * *